US005126174A

United States Patent [19]

Courtright et al.

[11] Patent Number: 5,126,174

[45] Date of Patent: Jun. 30, 1992

[54] FOOD PACKAGING IMPROVEMENTS

[75] Inventors: Steven B. Courtright; Gordon N. McGrew, both of Evanston; Lindell C. Richey, Lake Zurich, all of Ill.

[73] Assignee: Wm. Wrigley Jr. Company, Chicago, Ill.

[21] Appl. No.: 696,773

[22] Filed: May 7, 1991

Related U.S. Application Data

[62] Division of Ser. No. 311,703, Feb. 16, 1989, Pat. No. 5,064,698.

[51] Int. Cl.[5] ..... B29D 22/00

[52] U.S. Cl. ..... 428/34.3; 428/35.4; 428/35.9; 428/461; 428/485; 428/402

[58] Field of Search ..... 428/515, 34.3, 35.4, 428/35.9, 461, 483, 403

[56] References Cited

U.S. PATENT DOCUMENTS

| | | | |
|---|---|---|---|
| 2,765,233 | 10/1956 | Sarett et al. | 99/178 |
| 3,390,050 | 6/1968 | Speiser | 167/83 |
| 3,886,084 | 5/1975 | Vassiliades | 252/316 |
| 3,985,298 | 10/1976 | Nichols | 239/54 |
| 3,989,649 | 11/1976 | Kaiho et al. | 260/2.1 R |
| 4,322,311 | 3/1982 | Lim et al. | 252/316 |
| 4,324,683 | 4/1982 | Lim et al. | 252/316 |
| 4,407,957 | 10/1983 | Lim | 435/178 |
| 4,444,699 | 4/1984 | Hayford | 264/4.7 |
| 4,464,271 | 8/1984 | Munteanu et al. | 252/86 |
| 4,497,832 | 2/1985 | Cherukuri et al. | 426/5 |
| 4,673,577 | 6/1987 | Patel | 426/5 |
| 4,690,825 | 9/1987 | Won | 424/501 |

*Primary Examiner*—Edith L. Buffalow

*Attorney, Agent, or Firm*—Willian Brinks Olds Hofer Gilson & Lione

[57] ABSTRACT

A food packaging material that has a plurality of porous polymeric beads impregnated with an anti-oxidant, or oxygen scavenger compound.

8 Claims, 1 Drawing Sheet

FOOD PACKAGING IMPROVEMENTS

This is a division of application Ser. No. 07/311,703, filed Feb. 16, 1989, now U.S. Pat. No. 5,064,698.

BACKGROUND OF THE INVENTION

This invention relates to improvements in food packaging, particularly to a food packaging material having the ability to retard oxidation of its contents.

One of the persistent problems that face the food industry is oxidation of foods during storage. Oxidation is particularly a problem with fats and oils. Fats and oils oxidize upon exposure to oxygen, and a rancid flavor is imparted to the fat, oil, or food containing the fat or oil. The oxidation of fats and oils appears to be a self-catalytic reaction. Once part of the fats or oil is oxidized, the rest oxidizes relatively quickly. Thus, preventing or retarding the oxidation in the first place is paramount.

To retard oxidation, anti-oxidants have been added to foods. For instance, BHA [(1,1-dimethylethyl)-4-methoxy phenol] and BHT [2,6-di-tert-butyl-para-cresol] are common anti-oxidant food additives. However, BHA is regarded as moderately toxic by ingestion, and even though BHT is considered to have low toxicity, the use in foods of either of these compounds is limited to 0.02%. While these compounds have contributed greatly to the food industry by reducing the amount of food that must be discarded, some consumers prefer foods without them.

Another anti-oxidant is glucose oxidase. Glucose oxidase is a well characterized enzyme that catalyzes the oxidation of glucose, consuming oxygen in the process. It has been proposed (see, e.g., U.S. Pat. No. 2,765,233 to Saret) to treat food wrappers with glucose oxidase to increase the oxidation resistance of food packaged in such wrappers. However, there are limits to the amount of glucose oxidase that can be applied to food wrappers by conventional techniques.

SUMMARY OF THE INVENTION

The present invention is a food packaging material that forms a substantially air-tight enclosure when sealed. The packaging material has associated with an inside surface a plurality of porous polymeric beads impregnated with a substance that causes elemental oxygen in the sealed enclosure to react to form a substantially unreactive compound. Such compounds include BHT, BHA and glucose oxidase. The use of porous polymeric beads can increase the amount of such compounds in food packaging materials over what heretofore was possible without such beads. Furthermore such beads provide an economical and practicable vehicle to immobilize such compounds on or adjacent the inside surfaces of food packaging materials.

DESCRIPTION OF THE PRESENTLY PREFERRED EMBODIMENTS OF THE INVENTION

Figure 1:
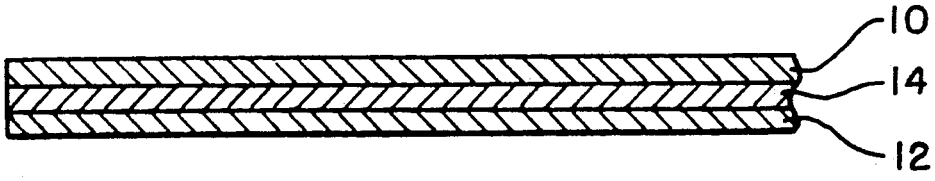
FIG. 1 is a cross-section of a first packaging material of this invention.

In the current invention, a food packaging material that can be used to form a sealed enclosure for food has associated with one of its surfaces porous polymeric beads that are impregnated with one or more compounds that cause elemental oxygen to react to form a substantially unreactive compound.

The food packaging material is a barrier material that resists air from penetrating the sealed enclosure from the outside. In this fashion, elemental oxygen other than that originally packaged with the food in the enclosure when it is sealed will not permeate the enclosure. Of course, many materials have limited permeability to elemental oxygen. Such limited permeability materials are considered barrier materials. Preferably, the permeability of the barrier material should be less than 25 cc of oxygen as determined by ASTM D1434-63.

The food packaging materials of this invention can be provided in a variety of forms: sheets, bags, boxes, and the like. Sheets can include single or multi-layer polymeric films, metal foils, paper, wax paper, cardboard, or combinations of these materials in multi-layer laminates. Sheets can be formed into sealed enclosures by wrapping the food in conventional ways, and sealing the sheet material to form a sealed enclosure. Sealing can be accomplished by heat sealing, gluing, taping, and the like.

Bags can also be formed from sheet material, or can be formed directly by extrusion, blow molding, and the like. Virtually any of the materials described above can be formed into a bag that can be sealed to form a sealed enclosure.

Boxes also can be fabricated from many of the sheet materials above. Boxes can also be formed by molding (injection or blow) and the like. Virtually any of the materials above can be formed into a box. Other forms of food packaging are contemplated: bottles, jars and the like made from air impermeable materials.

Polymeric beads of this invention are preferably of a size varying from between 10 and 100 microns, and the most preferred is between 20 and 50 microns. The beads contain microporous passages that are impregnated with the compounds herein described. The polymeric beads of this invention are polymerized in such a fashion that the microporous passages are formed during polymerization. Such a procedure is described below. Residual monomer can optionally be extracted, and the particles impregnated with the desired compound. Alternatively, the polymerization process can be carried out in a mixture containing the desired compound, so the desired compound is retained in the beads after polymerization. This latter method is preferred if monomer extraction is not desired. Details of microbead polymerization are described below, and in the examples that follow.

Compounds that can be used to impregnate beads either during or after polymerization include those compounds that cause elemental oxygen to react to form a substantially unreactive compound. By "elemental oxygen" is meant oxygen in the $O_2$ state, either as a free gas or dissolved in another substance. By a "substantially unreactive compound" is meant that the elemental oxygen is either bound so it cannot participate in a chemical reaction, or it reacts to form a compound that has a lower oxidation potential than elemental oxygen. Thus, the ability of the oxygen to oxidize the food is reduced. Such compounds include oxygen scavengers such as iron oxide, antioxidants such as BHA and BHT, or enzymes such as glucose oxidize that catalyze the reaction of oxygen with the enzyme substrate.

In addition, the beads can be impregnated with an aroma-generating compound together with oxygen scavengers, anti-oxidants or the like. By "aroma-generating compounds" is meant a compound that has a pleasing odor. Thus, the packaging material when ripped will release such aroma-generating compounds for instance, when the packaging is used for citrus fruits, the beads can be impregnated with limonene, lemon oil or the like, along with an oxygen scavenger, anti-oxidant or the like. Thus, when the consumer opens the package, an aroma compatible with the food is released.

It is also possible to coat the microbeads of this invention with one or more coatings. Such coatings include water-soluble and water-insoluble coatings described below. These coatings can retard the premature reaction of oxygen-reactive compounds in the beads while the beads are being processed, e.g. while the beads are being applied to the packaging material, or while the packaging material is being formed into a sealed enclosure. Such coatings should allow elemental oxygen in the sealed enclosure to diffuse through the coating at a rate such that the elemental oxygen will react with the compounds in the beads more quickly than with the food in the enclosure. Preferred coating materials are described below, along with methods of coating beads with such coatings.

Finally, the beads are applied to the surface of the barrier material that faces or will face toward the inside of the enclosure. The beads need not be applied to the entire inside face of the barrier material. Preferably, the beads are immobilized on an inside surface of the barrier material. Immobilization can be accomplished by gluing, tack-bonding, or covalent bonding the beads to an inside surface. Alternatively, the beads can be adhered by mixing them with an oxygen permeable coating (e.g. a wax or a polymer) that can be applied to the inside surface of the barrier material.

The steps of bead polymerization, monomer extraction, impregnation, application to a barrier material, and the like are described in detail in Section I–IV below, and in Examples I–VII that follow.

I. POLYMERIC BEAD POLYMERIZATION

In one embodiment of the present invention, the polymeric beads can be polymerized as taught in U.S. Pat. No. 4,690,825 to Won dated Sept. 1, 1987, the entire disclosure of which is incorporated herein by reference. Specifically, the beads used in the packaging material of the present invention can be prepared by polymerizing one or more polymers by a free radical suspension polymerization process. A monomer or pair of comonomers is dissolved in an inert porogen to form a solution that is suspended in a phase or solvent incompatible with that solution. Such a phase or solvent can be water with stabilizing additives. After the solution is suspended in the phase, the solution and phase are agitated to form droplets of solution suspended in the phase. After the formation of the droplets, the monomer or monomers in the droplets are activated to initiate a polymerization reaction in which the monomer is cross-linked or where two or more monomers are polymerized to form porous beads having a network of pores with the porogen within the network of pores. The activation may be triggered by an initiator that is insoluble with the monomer solution. Alternatively, activation may be triggered by an energy source such as radiation. The inert porogen serves as an internal diluent during polymerization and introduces the desired sponge-like microporous structure or network of pores into the finished bead. The inert porogen does not react with the monomer present during polymerization or inhibit the polymerization. The bead may or may not swell in the inert porogen. After formulation of the porous beads, the beads are separated from the phase and subjected to one or more extraction steps such as washing to remove any unreacted monomer or impurity from the beads. After an optional extraction of unreacted monomer, described below, the beads may be dried to obtain a powder-like substance that includes the beads but without either porogen or solvent.

An example of a polymer that can be used to form porous polymeric beads for the food product of this invention is a copolymer of divinylbenzene and styrene. Such beads can be polymerized in water as taught in the aforesaid Won patent or as described in Example I below. If such a copolymer is used, monomers (nonfood approved additions) are typically not completely reacted, and monomer concentration can be reduced to levels less than 30 ppm [as illustrated by the styrene monomer standards for food-grade styrenebutadiene rubber (Food Chemical Codex, 3rd Edition, pg. 42.)] if monomer concentration is of concern in a particular food packaging. Typically, the amount of free cross linking agent (divinylbenzene) in the beads after polymerization is quite low compared with styrene because divinylbenzene has two reaction sites, and thus is more reactive than styrene. Thus, the extraction is primarily to extract styrene monomer, the divinylbenzene monomer present in the polymer already being close to or lower than the 30 ppm value. An extraction procedure is explained in Section II below and in Example I.

To avoid or reduce the effort required in monomer extraction, one can copolymerize divinylbenzene with a food-grade monomer that can polymerize with divinylbenzene. By a food-grade monomer is meant any monomer that is a food additive permitted for direct addition to food for human consumption under 21 CFR, part 172 or substances generally recognized as safe under 21 CFR, part 182. Examples of such monomers are one or more of the following: estragole, limonene, carvone, eugenol and ocimene. Limonene is illustrative inasmuch as it is a naturally-occurring compound in many citrus fruits. Still other examples are provided in Example V, infra.

The food-grade monomer need not be extracted unless one wants to extract it for aroma reasons. If a packaging contains beads with a sufficient monomer concentration, the packaging can release the monomer aroma when it is ripped during opening. In many instances, the food-grade monomer may enhance the aroma of the food. Thus, any extraction of monomer after polymerization may only have to focus on divinylbenzene reduction, a comparatively simple proposition because it is already in comparatively low concentration.

In many cases unreacted monomer will not be of concern in packaging materials since they will not be consumed. In these cases, it may be advantageous to polymerize the beads in a solution containing the antioxidant, oxygen scavenger or enzyme compound(s). When polymerization is completed as described above and in the Won patent, the resulting beads will contain the compound(s). There is no need to impregnate the beads later with such compounds.

II. MONOMER EXTRACTION

If monomer extraction is desired or required, it can be accomplished by washing the beads first with water followed by several (preferably three) washings of isopropanol, four to five washings with acetone and four to five washings with hexane. The excess solvent is removed by evaporation under a nitrogen blanket to leave dry beads having a powder-like consistency.

III. POLYMERIC BEAD IMPREGNATION WITH OXYGEN REACTIVE COMPOUNDS

If anti-oxidant compounds are not already in the beads as a result of polymerization, such compounds can be impregnated into the beads by dissolving such compounds into a solvent, and immersing an equal weight of the beads in the solution. This process is preferably carried out in an oxygen-free environment if compounds such as BHT or BHA are employed. An oxygen-free environment can be created an maintained by performing such procedures under a nitrogen atmosphere in a conventional fashion. The solvent can optionally be evaporated by reduced pressure or by freeze drying, and the beads can be coated as described below, if desired.

The beads can also be impregnated with such compounds after polymerization by dispersing the compound(s) in a meltable carrier. The carrier is melted either before or after compound addition. The beads are added to the molten mixture, and allowed to absorb it. After impregnation, excess carrier is removed and the beads are cooled to instill the compounds into the beads.

IV. POLYMERIC BEAD COATING

As indicated above, the porous polymeric beads can be coated with a coating that retards the premature reaction of the anti-oxidant (or oxygen scavenger or enzyme) in the pores of the beads during storage or processing of the packaging material prior to packaging of the food. Illustrative coatings include water-soluble or permeable compositions such as hydroxypropyl methylcellulose, sugars, and the like.

Water-insoluble coatings may also be employed. Such coatings include food-grade shellac as disclosed in U.S. Pat. No. 4,673,577 to Patel dated June 16, 1987 that is incorporated herein by reference. Water-insoluble wax coatings also include waxes such as those disclosed in U.S. patent application Ser. No. 07/137,114 entitled Method of Making Chewing Gum with Wax-Coated Delayed Release Ingredients by Steven E. Zibell which is incorporated herein by reference, and zein.

Fatty acids can also be employed as coatings for the beads. Fatty acids, depending upon chain length, have varying water solubilities. Combinations or mixtures of various water-soluble and water-insoluble coating agents may be employed as well.

A variety of methods to coat the beads can be used. Several are described below.

A. Spray Drying

An emulsion/solution of anti-oxidant-impregnated beads and encapsulant is atomized into a gas stream that evaporates the solvent to leave coated beads. A Niro spray dryer may be used. The gas is preferably nitrogen that does not allow the antioxidant to react prematurely during this process.

B. Spray Chilling

A suspension of beads in molten encapsulant is atomized and chilled to produce beads coated with encapsulant.

C. Fluid Bed Coating

Beads are suspended in a gas stream (fluidized bed). The beads are sprayed with a solution of the encapsulant in a volatile solvent. The solvent is evaporated or dried by the gas stream to produce beads coated by the encapsulant. The gas is preferably nitrogen for reasons explained above.

D. Granulation/Agglomeration

A damp mix of beads and granulant is prepared, then dried and ground to desired particle size.

E. Gel Encapsulation

Beads are suspended in a gelatin solution that is cooled to gel, then ground to desired particle size.

F. Melt Blending

Beads are mixed into a molten agglomerant which is cooled to harden and ground to the desired particle size.

The following examples of the invention are provided by way of explanation and illustration. They are not intended to limit the invention.

EXAMPLE I

Chewing Gum Wrapping Material

A) Preparation of Microbeads

Gelatin (250 mg) is added to a three-necked flask purged with nitrogen. Water (150 ml) is heated to 50° C. and added to the flask to dissolve the gelatin. While the contents of the flask are stirred, a freshly prepared solution of benzoyl peroxide (1.25 grams; 1.03 mmole) and styrene (22.9 grams; 0.22 mole) monomer is added, followed by divinylbenzene (12.0 grams; 42 mmoles). The mixture is heated to 90° C. while maintaining a constant stirring rate, and passing nitrogen through the flask.

The mixture is stirred for two hours, and cooled to room temperature, and the supernatant liquid is decanted. The polymer beads are washed with hexane several times, and stirred in hexane (200 ml) for two hours to remove any excess divinylbenzene or styrene, and dried overnight at 50° C. in a vacuum to yield dry microbeads.

B) Oxygen-Scavenger-Impregnated Beads

Beads from Part A are soaked under a vacuum (15 psi) for 48 hours in the following slurry:

50 parts vegetable oil
50 parts Ageless 5-300

Ageless 5-300 is a powdered oxygen scavenger made from iron-oxide and activated charcoal available from the Mitsubishi Gas Chemical Company of Japan. After soaking, the excess oil is filtered off.

C) Chewing Gum Wrapping Material

A wrapping material for chewing gum is prepared in a conventional gum wrapping machine by laminating a foil layer 10 and a tissue layer 12 (FIG. 1) with a wax layer 14 that has the composition set forth in Table I.

Table I

40% Microcrystalline Wax (m.p. 140° F.)
40% Paraffin Wax (m.p. 115° F.)
20% Beads from Part B The resulting wrapping material is shown in FIG. 1.

Tissue layer 12 goes toward the chewing gum. Tissue layer 12 allows oxygen to pass through it to be absorbed by the oxygen scavenger in the beads in layer 14.

EXAMPLE II

Fresh Fruit Bag

A) Oxygen-Scavenger-Impregnated Beads

Beads prepared as described in Example I, Part A are mixed with an equal weight of a mixture containing vegetable oil (50 parts), zeolite (25 parts) and Ageless 5-300 (25 parts). The beads are filtered from the excess oil mixture after 48 hours.

B) Fresh Fruit Bag

Figure 2:
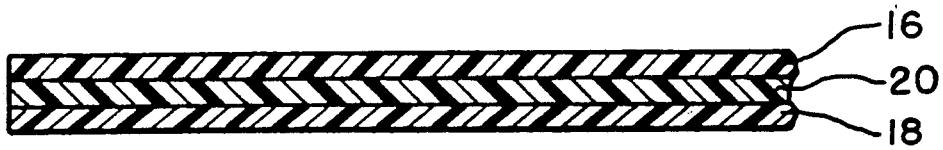
FIG. 2 is a cross-section of a second packaging material of this invention.

The beads from Part A are mixed with a granular thermoplastic hot melt material (e.g., granular polyethylene) in a 20% bead/80% hot melt ratio by weight. The hot melt is then used to laminate an oxygen barrier material 16 (FIG. 2) such as saran to a polyethylene film layer 18 in a conventional fashion so that a hot melt layer 20 containing an oxygen-scavenger is disposed between and adheres an oxygen impermeable layer 16 and an oxygen permeable layer 18. This multilayer film is then formed into a bag in a conventional manner with the polyethylene film layer 18 forming the inside surface of the bag. The bag can then be used for packaging fresh fruit such as apples.

EXAMPLE III

Screw-Type Container Closure

Figure 3:
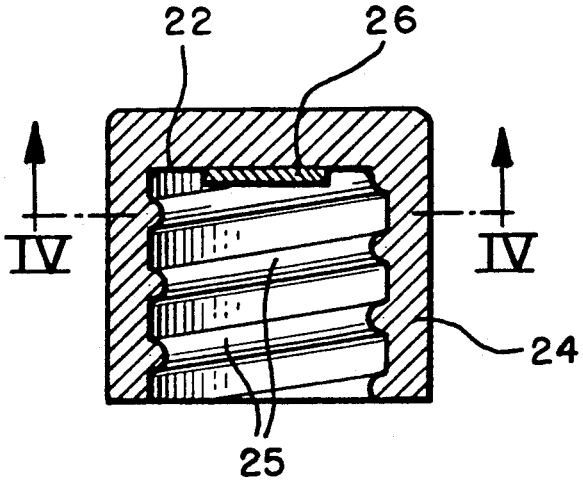
FIG. 3 is a cross-section of a screw-type container cap.
Figure 4:
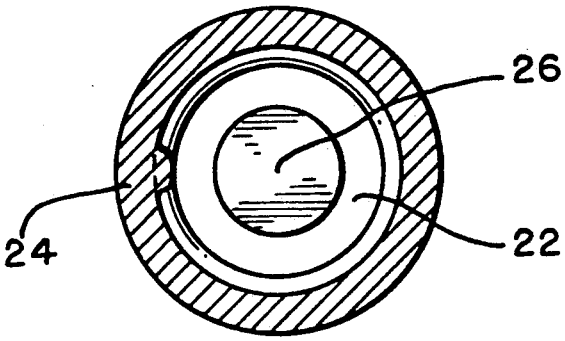
FIG. 4 is a cross-section taken along the plane of line IV—IV of FIG. 3.

Oxygen-scavenger-impregnated microbeads prepared as described in Example I. Part B are mixed with an equal weight of a molten microcrystalline wax having a melting point of 60° C. The mixture is applied to the inside upper surface 22 (FIGS. 3-4) of a conventional gas impermeable, screw-type container closure 24 with screw threads 25 for threading onto a container. Preferably the mixture is applied to form a button 26 disposed centrally on the upper inside surface 22 of closure 24 so that when closure 24 is screwed onto a container, the container will not contact button 24, and button 24 will be exposed to the inside of the container. Thus, button 24 will be exposed to the air of the headspace in the container to scavenge any oxygen in the headspace.

EXAMPLE IV

Cereal Pouch

Microbeads prepared as described in Example I, Part A are soaked for 48 hours in an equal weight of a solution containing vegetable oil (9 parts) and BHA (1 part). The excess oil solution is filtered off.

The beads are then blended into a molten wax that has a melting point of 60° C. The wax is then applied to one side of a saran sheet that is then formed into a pouch for dry cereal. The waxed side of the sheet forms the inside surface of the pouch. The pouch can be sealed by heat sealing the open end of the pouch after the pouch is filled with cereal.

EXAMPLE V

Alternative Microbead Formulations

Various microbead polymers are possible consistent with the teachings of this invention. A number of types of microbeads can be prepared following the procedure set forth in Example I part A, altering the amount of monomer to be polymerized with divinylbenzene, or changing the monomer to be polymerized with divinylbenzene. Alternatively, the amount of divinylbenzene can be varied. A summary of such microbead formulations is set forth in Table II below.

TABLE II

| Monomer | Monomer Amount | Divinylbenzene Amount |
|---|---|---|
| a) Estragole | 32.6 g; 0.22 mole | 33 g |
| b) Estragole | 32.6 g; 0.22 mole | 98 g |
| c) Allyl cyclohexyl propionate | 43.12 g; 0.22 mole | 12 g |
| d) Allyl cyclohexyl propionate | 43.12 g; 0.22 mole | 33 g |
| e) Allyl cyclohexyl propionate | 43.12 g; 0.22 mole | 97 g |
| f) Ocimene | 29.92 g; 0.22 mole | 12 g |
| g) Ocimene | 29.92 g; 0.22 mole | 33 g |
| h) Ocimene | 29.92 g; 0.22 mole | 97 g |
| i) Divinylsulfide | 18.96 g; 0.22 mole | 12-97 g |
| j) Vinyl methylketone | 15.42 g; 0.22 mole | 12-97 g |
| k) 4-methyl-5-vinyl thiazole | 27.5 g; 0.22 mole | 12-97 g |
| l) 2-methyl-5-vinyl pyrazine | 26.1 g; 0.22 mole | 12-97 g |
| m) Vinyl pyrazine | 23.32 g; 0.22 mole | 12-97 g |
| n) 1-penten-3-ol | 18.92 g; 0.22 mole | 12-97 g |
| o) 1-octen-3-ol | 28.16 g; 0.22 mole | 12-97 g |
| p) carvone | 33.00 g; 0.22 mole | 12-97 g |
| q) limonene | 29.92 g; 0.22 mole | 12-97 g |
| r) diallyl-disulfide | 32.18 g; 0.22 mole | 12-97 g |
| s) allylsulfide | 25.13 g; 0.22 mole | 12-97 g |
| t) allyl alpha ionone | 51.12 g; 0.22 mole | 12-97 g |

The monomers identified above to be polymerized with divinylbenzene can also be combined with styrene to yield the desired beads. In addition, divinylbenzene can be replaced with allylacrylate as the crosslinker or with other suitable divinyl compounds.

Microbeads produced from the polymers described above are made from food-grade monomers that can polymerize with divinylbenzene. The residual food-grade monomer in the microbeads can contribute aroma to the packaging. Accordingly, to achieve a proper combination of food-grate monomer with the flavoring of the food in the packaging, certain combinations of food-grade monomer and foods are preferred, as indicated in Table III below.

TABLE III

| Gum Flavoring | Monomer(s) |
|---|---|
| Mint | Estragole, ocimene, vinylmethyl ketone, 1-octen-3-ol, 1-penten-3-ol, carvone, limonene, allyl alpha ionone |
| Onion | Divinylsulfide, diallyldisulfide, allylsulfide |
| Citrus | Ocimene, carvone, limonene |
| Peanut | 4-methyl-5-vinylthiazole, 2-methyl-5-vinylpyrazine, vinylpyrazine |
| Meat | 4-methyl-5-vinylthiazole, 2-methyl-5-vinylpyrazine, vinylpyrazine, diallyldisulfide, allylsulfide |
| Fruit | Eugenol, allylcyclohexyl propinate, limonene |

TABLE III-continued

| Gum Flavoring | Monomer(s) |
|---|---|
| Cinnamon | Estragole, eugenol, limonene |

The polymerized food-grade monomer also forms a polymer with regions that have an affinity toward certain anti-oxidants that can be absorbed into the microbeads. This can improve the impregnation of the anti-oxidants into the pores of the polymeric beads. These regions are essentially polymeric chains of food-grade monomer. If the anti-oxidant can dissolve into or has an affinity toward the food-grade monomer, the anti-oxidant will likely have an affinity toward the polymeric chains in these regions.

EXAMPLE VI

Polymeric Beads Including Styrene-Butadiene Rubber

Styrene-butadiene rubber (10.0 g) is dissolved in toluene (90.0 g). In a separate beaker, polyvinylalcohol (1.5 g) is dissolved in water (450.0 g) at about 40° C. The copolymer solution is mixed with styrene monomer (150.0 g) and divinylbenzene monomer (30.0 g). Benzoyl peroxide (1.5 g) is added to the mixture, and the mixture is agitated at room temperature. The mixture with copolymer is added to the polyvinylalcohol solution, and the combined mixture is agitated with a motor-driven propeller.

The mixture is heated to 80°-90° C. for at least four hours during which time it is agitated. The mixture is cooled, and filtered to remove the beads. The beads can be used in any of the formulations in the previous examples to produce a packaging material.

While several embodiments of the invention have been described, other embodiments will be apparent to those of ordinary skill in the art. Such embodiments are to be included within the scope of the present invention unless the following claims expressly state otherwise.

We claim:

1. A multilayer packaging film comprising a substantially oxygen impermeable barrier first layer; and an oxygen permeable second layer containing a plurality of porous polymeric beads impregnated with a substance that causes elemental oxygen to react to form a substantially unreactive compound.

2. The multilayer packaging film of claim 1 further including an oxygen permeable third layer disposed on said second layer so said second layer is between the first and third layers.

3. The multilayer packaging film of claim 1 wherein said third layer comprises polyethylene said second layer comprises a thermoplastic material, and said first layer comprises saran.

4. The multilayer film of claim 1 wherein said third layer comprises a paper, said second layer comprises a wax, and said first layer comprises a metal foil.

5. The multilayer film of claim 1 wherein said substance is selected from the group consisting of iron oxide, BHA, BHT and glucose oxidase.

6. The multilayer film of claim 1 wherein said beads comprise a copolymer of styrene and divinylbenzene.

7. The multilayer film of claim 3 wherein said film is formed by mixing said beads into a granular thermoplastic material and adhering said first and third layers by introducing the mixture between the first and third layers, and heating the thermoplastic material.

8. The multilayer film of claim 7 wherein said film is formed into a sealable enclosure with said third layer forming the inside surface of said enclosure.

* * * * *